US012544876B2

(12) United States Patent
Numata

(10) Patent No.: US 12,544,876 B2
(45) Date of Patent: Feb. 10, 2026

(54) GRINDING TOOL

(71) Applicant: MAKITA CORPORATION, Anjo (JP)

(72) Inventor: Fumitoshi Numata, Anjo (JP)

(73) Assignee: MAKITA CORPORATION, Anjo (JP)

( * ) Notice: Subject to any disclaimer, the term of this patent is extended or adjusted under 35 U.S.C. 154(b) by 491 days.

(21) Appl. No.: 18/170,749

(22) Filed: Feb. 17, 2023

(65) Prior Publication Data

US 2023/0330808 A1 Oct. 19, 2023

(30) Foreign Application Priority Data

Apr. 19, 2022 (JP) ..... 2022-069015

(51) Int. Cl.
*B24B 49/10* (2006.01)
*B24B 23/02* (2006.01)

(52) U.S. Cl.
CPC ..... *B24B 49/10* (2013.01); *B24B 23/028* (2013.01)

(58) Field of Classification Search
CPC ..... B24B 23/02; B24B 49/10; B24B 23/028
See application file for complete search history.

(56) References Cited

U.S. PATENT DOCUMENTS

2019/0232456 A1* 8/2019 Sugita ..... B24B 47/12
2020/0384597 A1* 12/2020 Numata ..... B25F 5/026
2020/0384627 A1 12/2020 Numata

FOREIGN PATENT DOCUMENTS

JP 2019-098446 A 6/2019
JP 2020-199590 A 12/2020

OTHER PUBLICATIONS

Sep. 30, 2025 Office Action issued in Japanese Patent Application No. 2022-069015.

* cited by examiner

*Primary Examiner* — Thomas M Wittenschlaeger
(74) *Attorney, Agent, or Firm* — Oliff PLC

(57) ABSTRACT

A grinding tool facilitates wiring between a detector for an auxiliary handle and a controller. A grinding tool includes a motor, a housing including an inner housing accommodating the motor and an outer housing covering an exterior of the inner housing and extending rearward from the inner housing, a spindle protruding from a front of the housing, rotatable when driven by the motor, and including a protruding end to receive a tip tool, a controller that controls driving of the motor, a handle mount located at the front of the housing to receive an auxiliary handle in a detachable manner, a handle detector that electrically detects an attachment of the auxiliary handle to the handle mount, and wiring extending between the inner housing and the outer housing to electrically connect the controller and the handle detector.

11 Claims, 13 Drawing Sheets

GRINDING TOOL

CROSS-REFERENCE TO RELATED APPLICATIONS

This application claims the benefit of priority to Japanese Patent Application No. 2022-069015, filed on Apr. 19, 2022, the entire contents of which are hereby incorporated by reference.

BACKGROUND

1. Technical Field

The present disclosure relates to a grinding tool such as a grinder. In one or more embodiments of the present disclosure, grinding includes polishing.

2. Description of the Background

A grinder as an example of a grinding tool includes a motor, a housing, a spindle, and a tip tool. The housing accommodating the motor extends in the front-rear direction. The spindle protrudes downward from the front of the housing. The tip tool is, for example, a grinding disc attached to a lower end of the spindle. The tip tool rotates together with the spindle for grinding and other operations on a workpiece.

As described in Japanese Unexamined Patent Application Publication No. 2020-199590 (hereafter referred to as Patent Literature 1), a rear portion of the housing is a main handle of the grinder. A side handle (auxiliary handle) is attachable selectively on either the left or right side of a front portion of the housing. An operator holds the rear portion of the housing with one hand and the side handle with the other hand to operate the grinder.

This grinder includes a handle detector that electrically detects attachment of the auxiliary handle to prevent kickback in which the grinder is swung around with a reaction force received by the tip tool from the workpiece. Although a switch is turned on, a controller does not drive the motor unless the controller obtains a detection signal from the handle detector.

BRIEF SUMMARY

The controller may be located behind the motor in the housing. In this case, a mount for the auxiliary handle on the front of the housing is to be connected to the controller at the rear of the housing with wiring. Such wiring is difficult to avoid the motor and a fan.

One or more aspects of the present disclosure are directed to a grinding tool that facilitates wiring between a detector for an auxiliary handle and a controller.

A first aspect of the present disclosure provides a grinding tool, including:

- a motor;
- a housing extending in a front-rear direction, the housing including
  - an inner housing being cylindrical and accommodating the motor, and
  - an outer housing being cylindrical and covering an exterior of the inner housing, the outer housing extending rearward from the inner housing;
- a spindle protruding from a front of the housing and being rotatable when driven by the motor, the spindle including a protruding end to receive a tip tool;

- a controller configured to control driving of the motor;
- at least one handle mount located at the front of the housing to receive an auxiliary handle in a detachable manner;
- a handle detector configured to electrically detect an attachment of the auxiliary handle to the at least one handle mount; and
- wiring extending between the inner housing and the outer housing to electrically connect the controller and the handle detector.

The structure according to the above aspect of the present disclosure facilitates wiring between the detector for the auxiliary handle and the controller.

DETAILED DESCRIPTION

Embodiments of the present disclosure will now be described with reference to the drawings.

Figure 1:
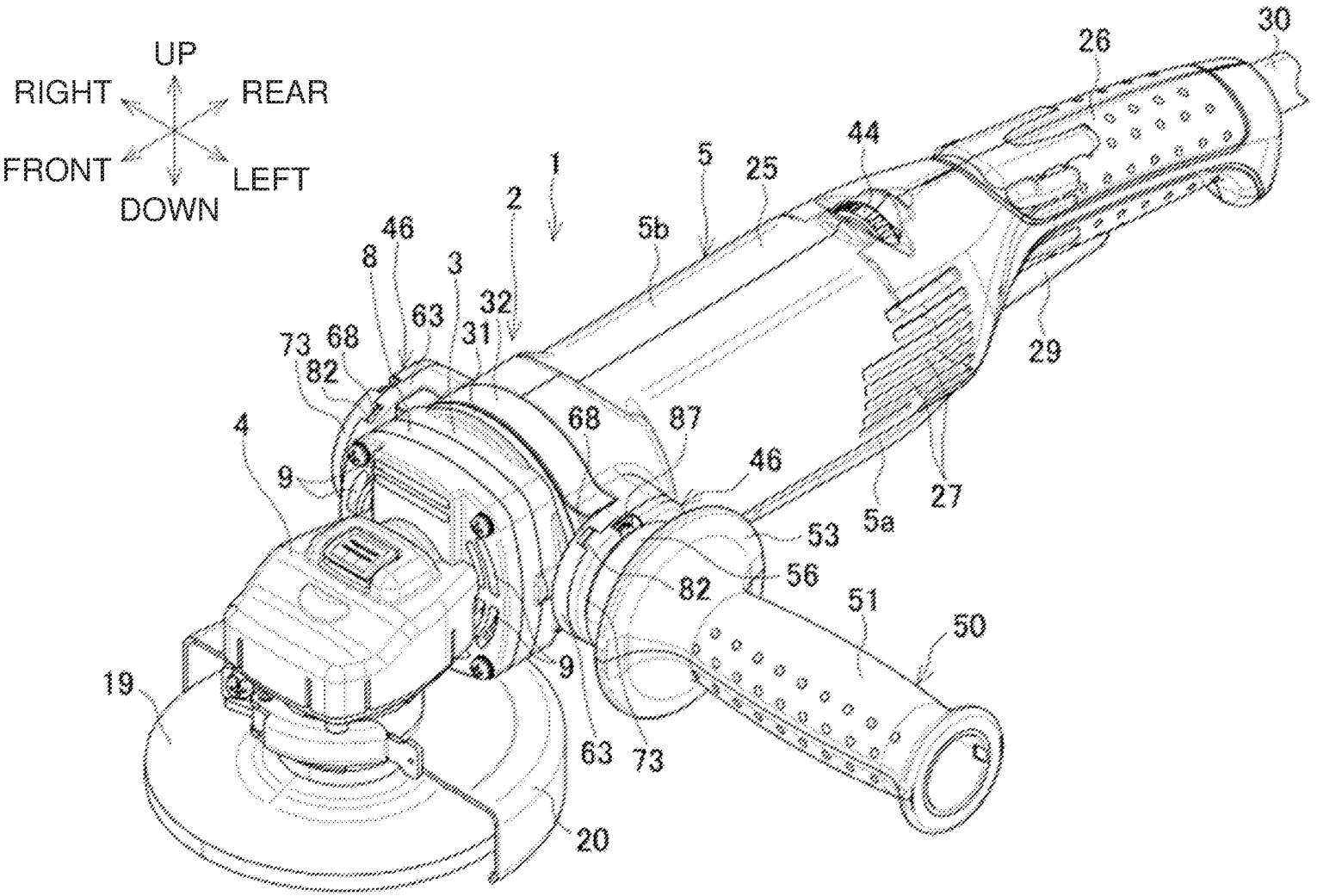
FIG. 1 is a perspective view of a grinder.
Figure 2:
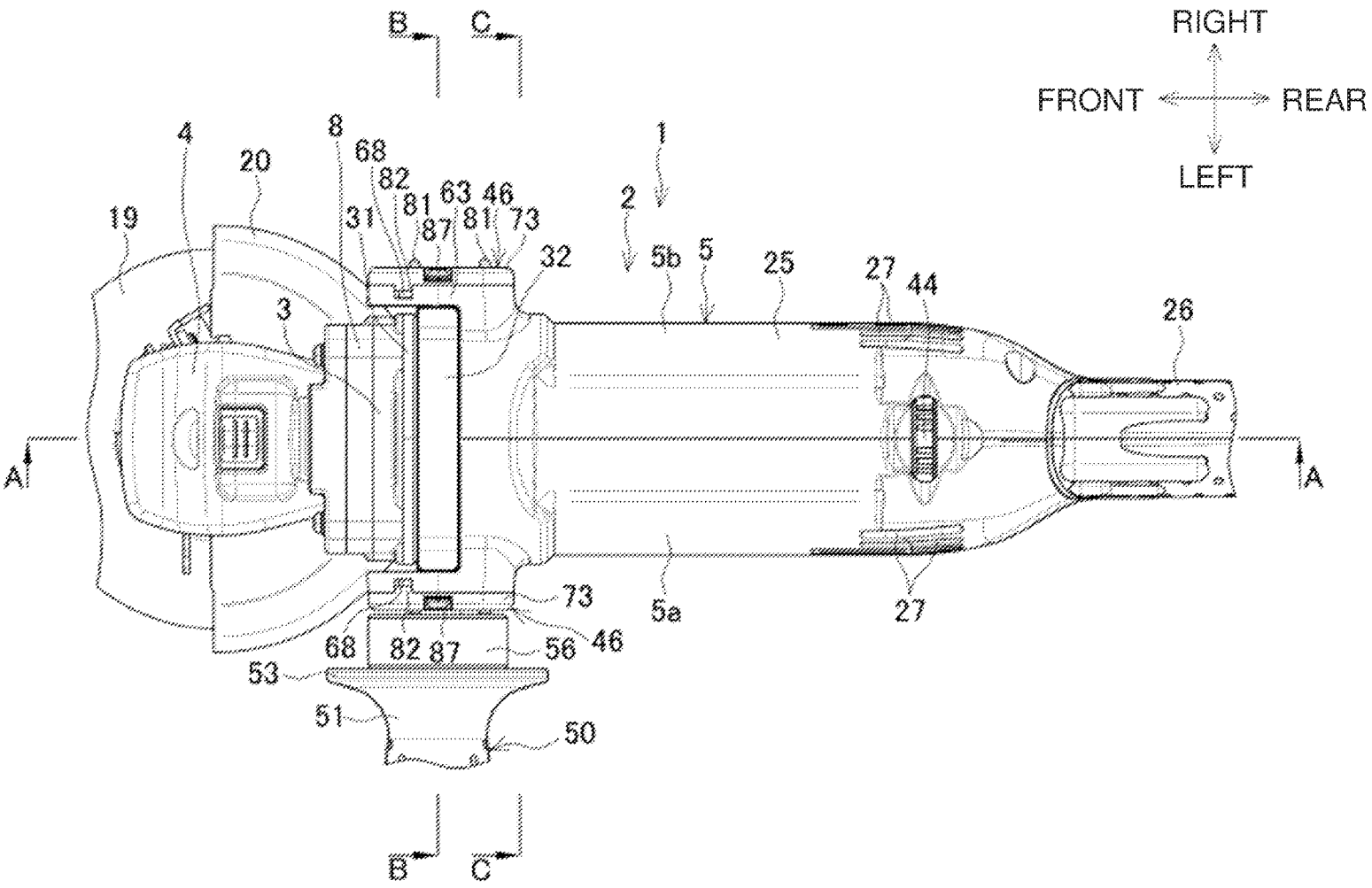
FIG. 2 is a plan view of the grinder.
Figure 3:
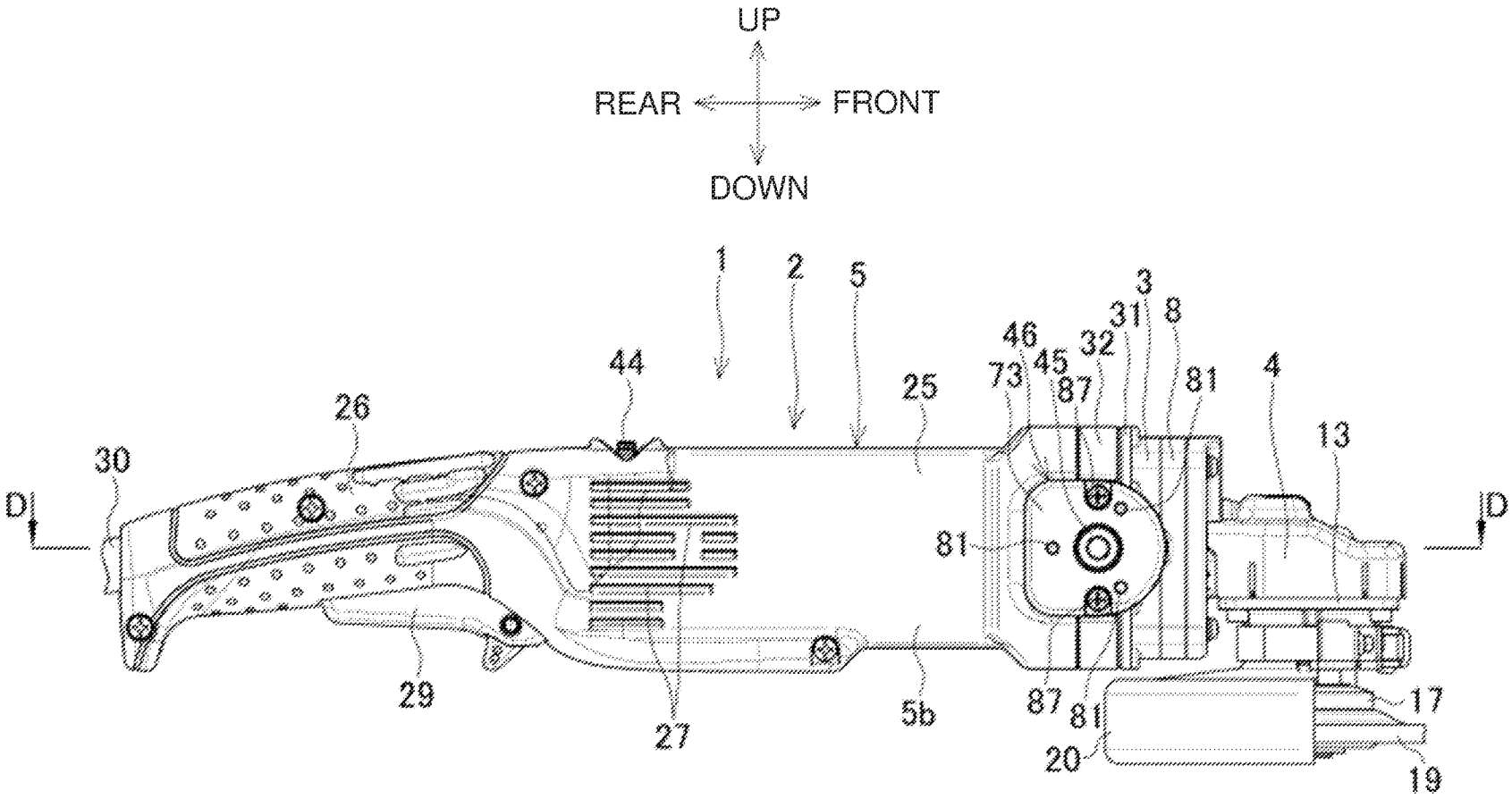
FIG. 3 is a left side view of the grinder.
Figure 4:
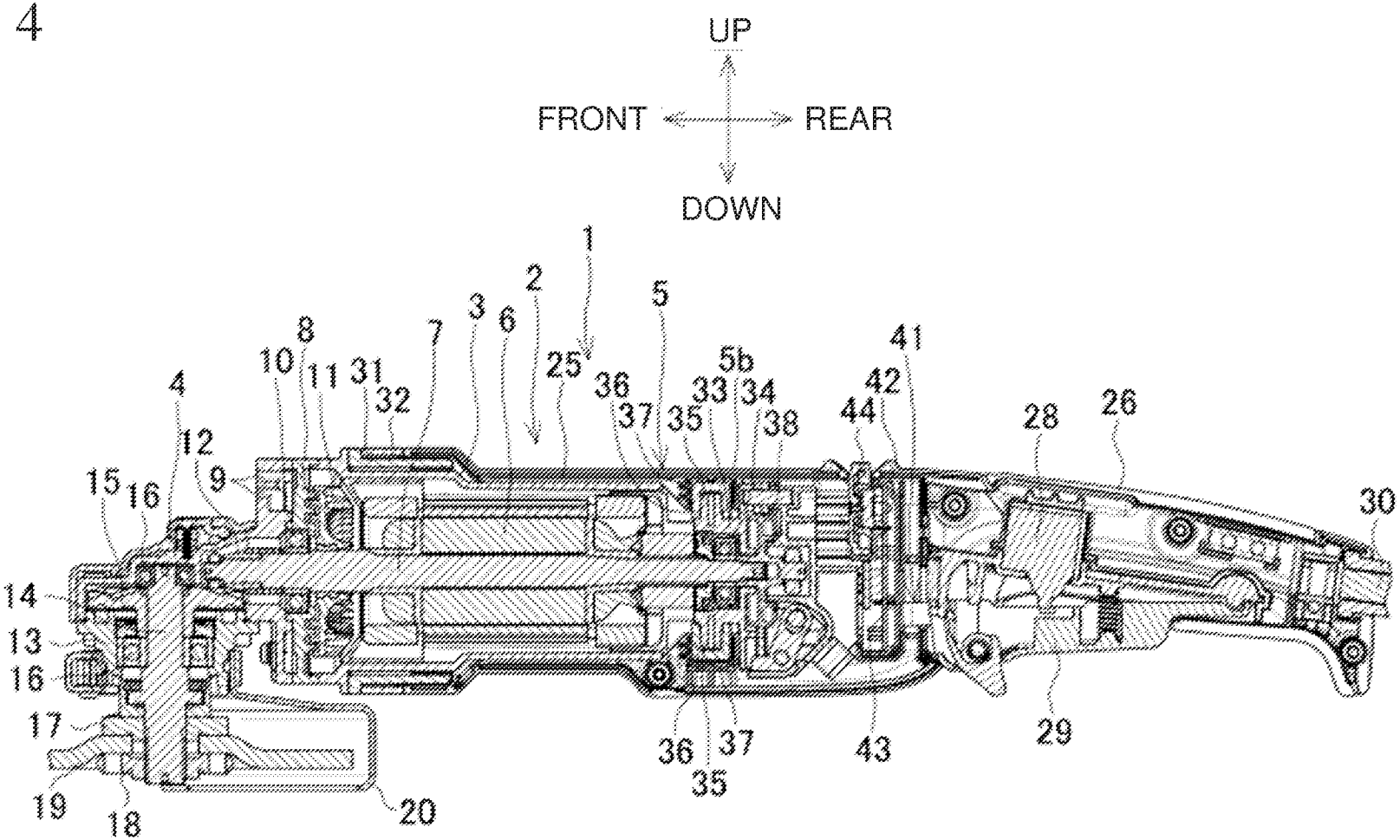
FIG. 4 is a sectional view taken along line A-A in FIG. 2.

FIG. 1 is a perspective view of a grinder as an example of a grinding tool. FIG. 2 is a plan view of the grinder. FIG. 3 is a left side view of the grinder. FIG. 4 is a sectional view taken along line A-A in FIG. 2.

A grinder 1 includes a housing 2 extending in the front-rear direction. The housing 2 includes an inner housing 3, a gear housing 4, and an outer housing 5. The inner housing 3 and the outer housing 5 are formed from a resin. The gear housing 4 is formed from a metal.

The inner housing 3 is cylindrical and accommodates a motor 6 (commutator motor). The motor 6 is held in the inner housing 3 with an output shaft 7 extending in the front-rear direction.

The gear housing 4 is fastened to the inner housing 3 with screws from the front with a gear housing cover 8 in between. The gear housing 4 has multiple outlets 9 in the front surface. Each outlet 9 connects with the inside of the inner housing 3. The output shaft 7 includes its front portion protruding into the gear housing 4 through the gear housing cover 8. The gear housing cover 8 receives a bearing 10 for supporting the output shaft 7. Behind the gear housing cover 8, a fan 11 is fixed to the output shaft 7.

A bevel gear 12 is mounted at the front end of the output shaft 7 in the gear housing 4. The gear housing 4 receives a bearing box 13 attached to its lower portion. A spindle 14 is located in the gear housing 4 and the bearing box 13. The spindle 14 extends vertically. The spindle 14 receives a bevel gear 15 in its upper portion. The bevel gear 15 meshes with the bevel gear 12 on the output shaft 7.

The spindle 14 is axially supported by upper and lower bearings 16. The upper bearing 16 is held in the gear housing 4. The lower bearing 16 is held in the bearing box 13. The spindle 14 has its lower end protruding downward from the bearing box 13. The lower end of the spindle 14 can receive a tip tool 19 (e.g., a grinding disc) in a detachable manner with an inner flange 17 and a lock nut 18. A wheel cover 20 is attached to the bearing box 13. The wheel cover 20 covers a rear upper portion and a rear portion of the tip tool 19.

The outer housing 5 is cylindrical and includes a pair of left and right housing halves 5*a* and 5*b* screwed together in the lateral direction. The outer housing 5 includes a body 25 in its front portion and a main grip 26 in its rear portion. The body 25 has multiple inlets 27 in its left and right rear side surfaces. The main grip 26 has a smaller diameter than the body 25. The main grip 26 obliquely extends downward from a position off and above the axis of the body 25 toward the rear. The main grip 26 includes a switch 28 and a switch lever 29. The switch lever 29 is vertically swingable about its rear end as a pivot. The switch lever 29 is pushed upward to turn on the switch 28. The main grip 26 has its rear end connected to a power cable 30.

The body 25 includes a front portion coaxially holding the inner housing 3 with a rubber sleeve 31 in between. The body 25 receives a metal fixing ring 32 at its front. The fixing ring 32 is externally mounted on the rubber sleeve 31. The outer housing 5 is connected to the fixing ring 32 with extensions 63 (described later) screwed to the fixing ring 32.

Figure 6:
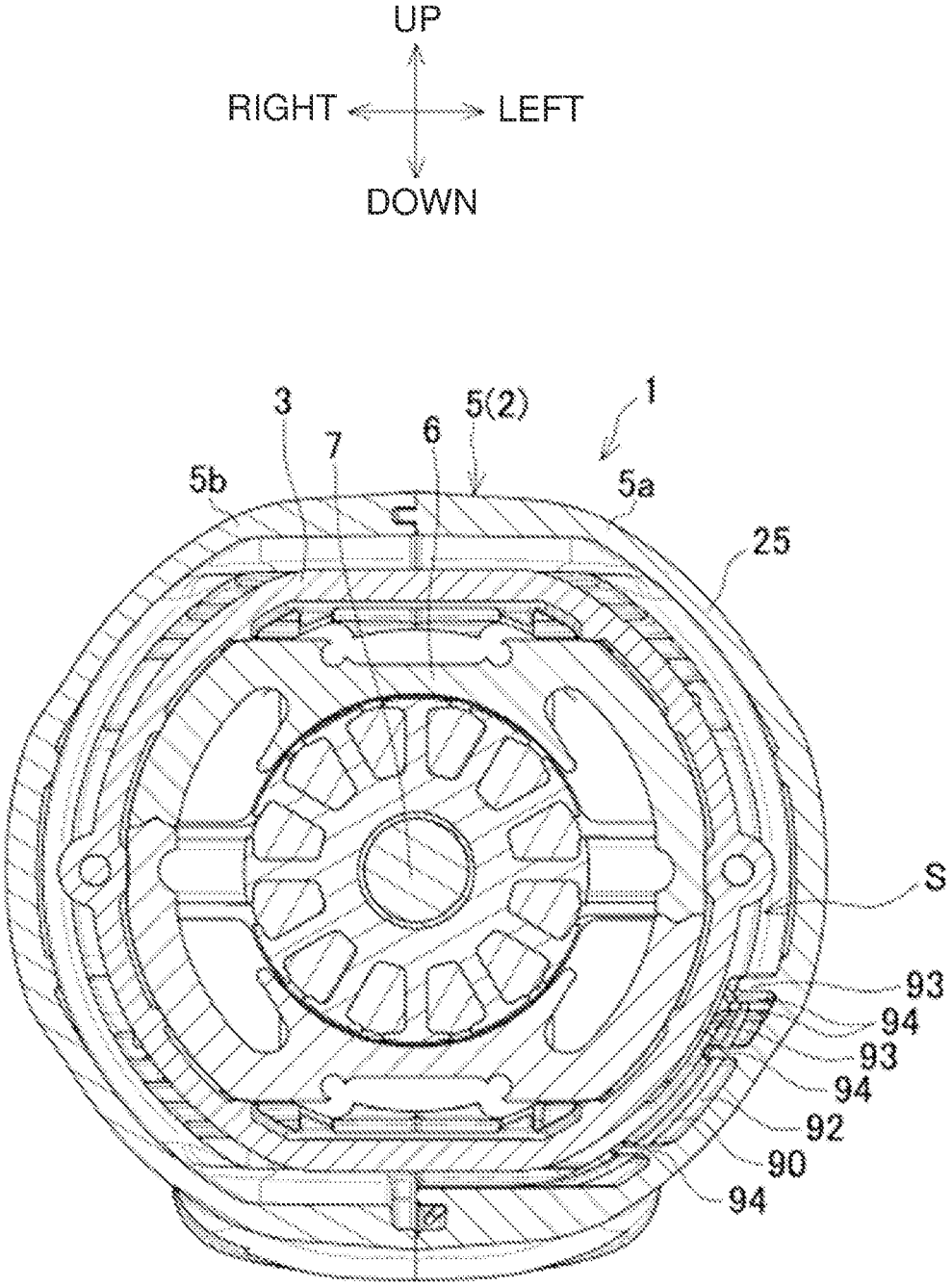
FIG. 6 is an enlarged sectional view taken along line C-C in FIG. 2.
Figure 10:
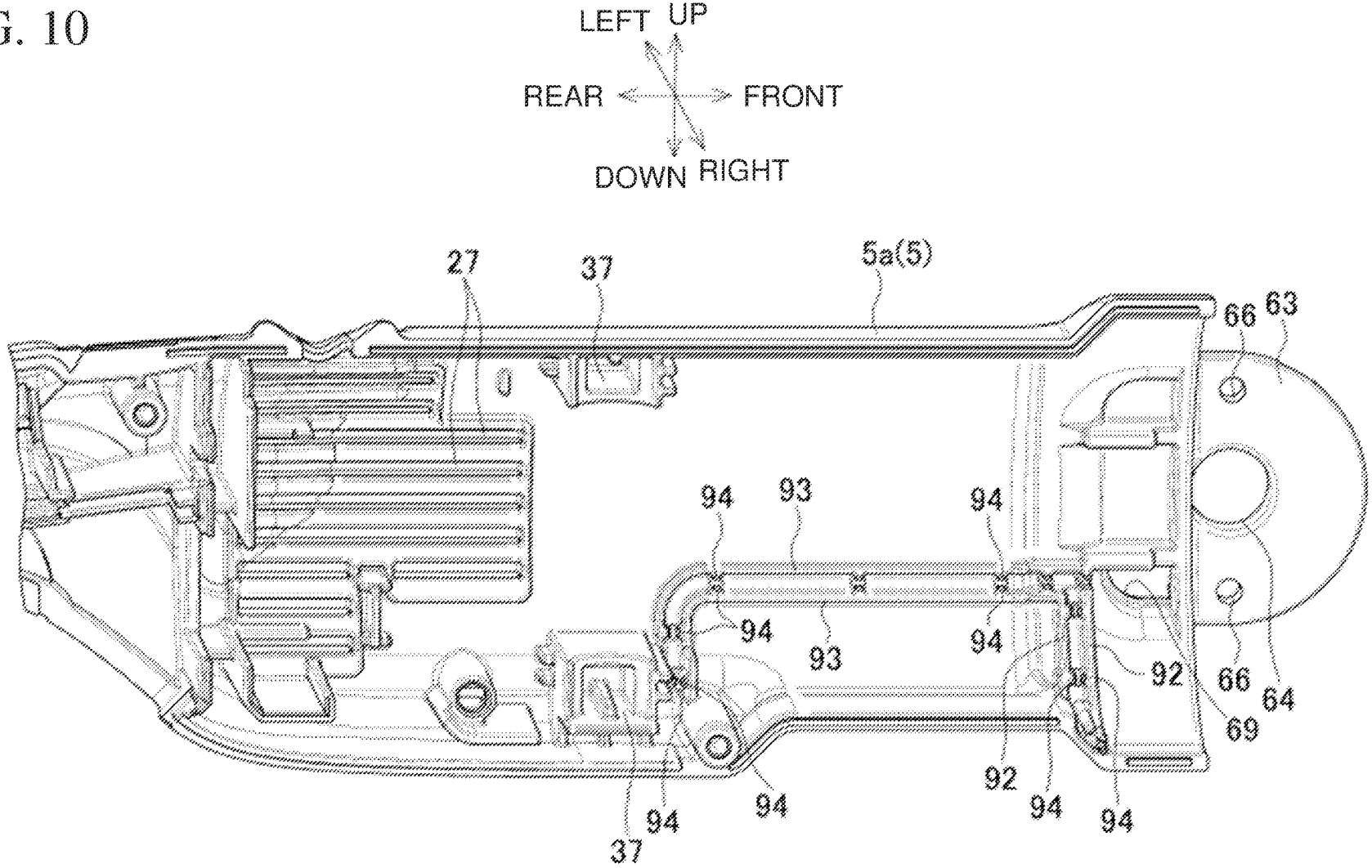
FIG. 10 is a perspective view of a left housing half.

A bearing retainer 33 is integral with a rear portion of the inner housing 3. The output shaft 7 protrudes rearward from a commutator. The output shaft 7 is supported by a bearing 34 held by the bearing retainer 33. The bearing retainer 33 includes a pair of upper and lower support projections 35. The pair of support projections 35 are coaxial in the vertical direction perpendicular to the axis of the output shaft 7. Each support projection 35 receives a rubber cap 36. As also shown in FIG. 10, holders 37 are located on the upper and lower inner surfaces of the left and right housing halves 5*a* and 5*b*. The holders 37 protrude inward in the lateral direction to hold the upper and lower rubber caps 36 at the middle. Thus, the inner housing 3 is elastically supported in the outer housing 5 with the rubber sleeve 31 at the front and the rubber caps 36 at the rear. In this state, a cylindrical space S is defined between the inner housing 3 and the outer housing 5 along the entire circumference, as shown in FIG. 6.

Figure 7:
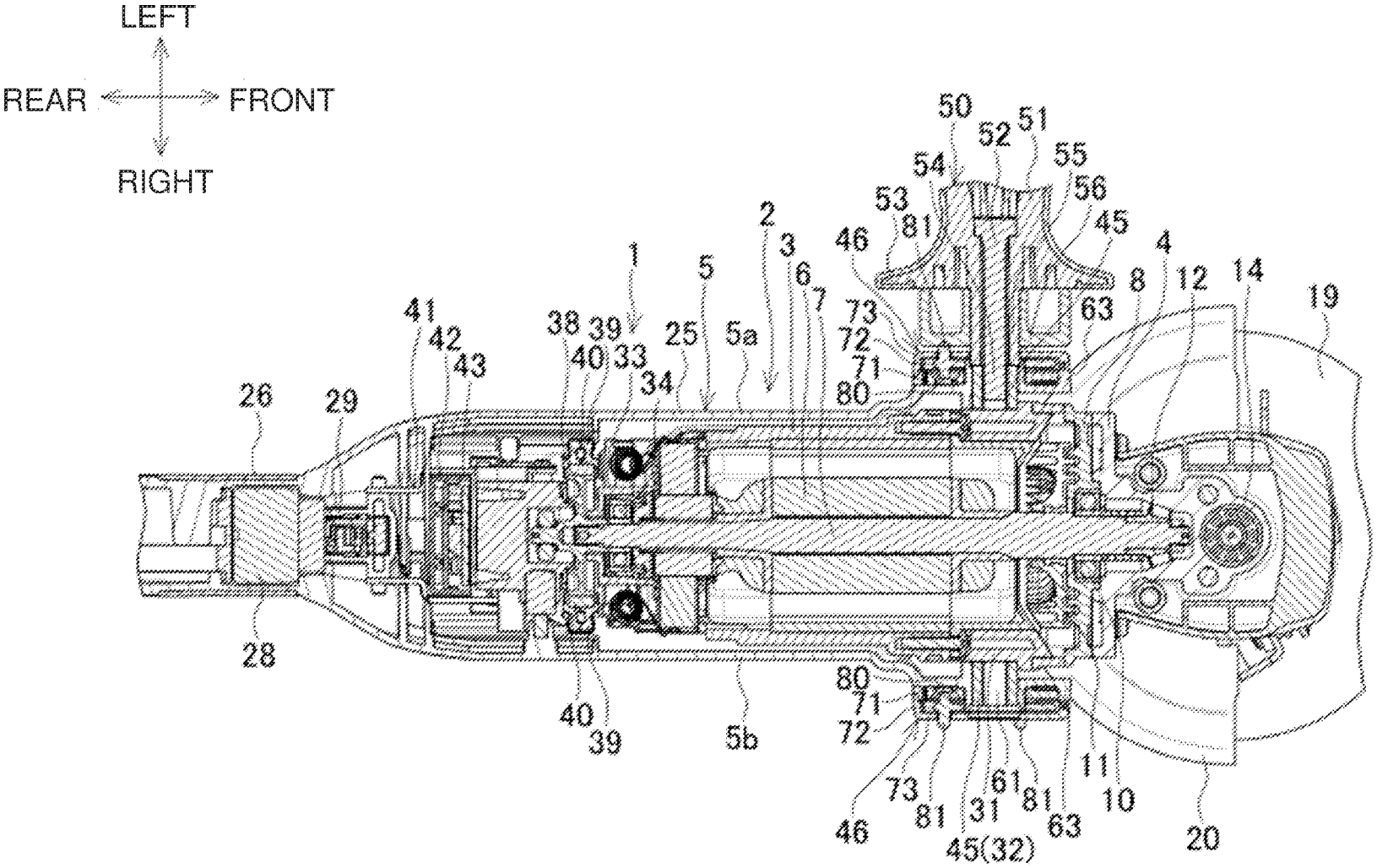
FIG. 7 is a sectional view taken along line D-D in FIG. 3.

The output shaft 7 has its rear end extending rearward through the bearing retainer 33. A brake drum 38 is fixed to the rear end of the output shaft 7. A pair of brake arms 39 are located on the left and right sides of the brake drum 38 in the body 25, as shown in FIG. 7. Each brake arm 39 is supported to be laterally swingable about its upper end as a pivot. Each brake arm 39 includes a brake shoe 40 facing the outer circumferential surface of the brake drum 38. The brake arms 39 are urged toward the brake drum 38.

The brake arms 39 operate in cooperation with a swing of the switch lever 29 with a linkage 41. At the lower limit position of the switch lever 29 at which the switch 28 is off, the brake drum 38 is pressed against the brake shoes 40. Thus, the rotation of the brake drum 38 and the output shaft 7 is regulated. When the switch lever 29 is pushed upward to turn on the switch 28, the brake arms 39 are separate to be open with the linkage 41. The pressure on the brake drum 38 applied by the brake shoes 40 is then released. This allows the brake drum 38 and the output shaft 7 to rotate.

A controller 42 is located behind the brake drum 38 in the body 25. The controller 42 is held vertically at the middle in the lateral direction. The controller 42 includes a control circuit board 43 receiving, for example, a microcomputer and a memory. An adjustment dial 44 is located on an upper front surface of the control circuit board 43. As shown in FIGS. 1 to 4, an upper portion of the adjustment dial 44 is exposed above the outer housing 5. The rotational speed of the motor 6 can be adjusted by rotating the adjustment dial 44.

The housing 2 includes handle mounts 45 and handle detectors (hereafter referred to as detectors) 46 on the front left and the front right. Each handle mount 45 receives a side handle 50 in a detachable manner. Each handle detector 46 detects attachment of the side handle 50 to the handle mount 45. This will be described in detail below. The handle mounts 45 and the detectors 46 are symmetric to each other. The handle mount 45 and the detector 46 on the left will be described mainly.

Figure 8:
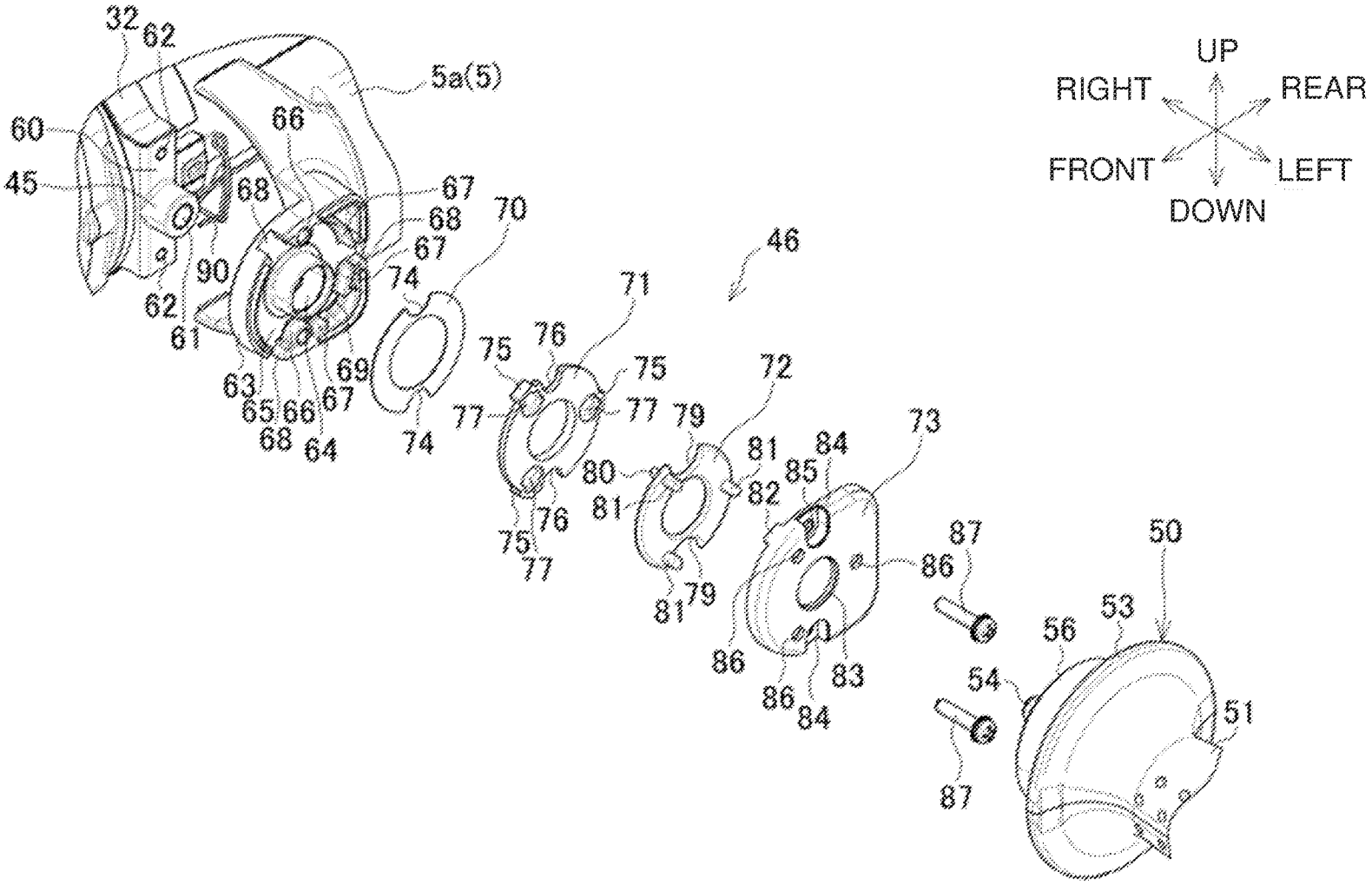
FIG. 8 is an exploded perspective view of a handle mount and a handle detector as viewed from the left.
Figure 9:
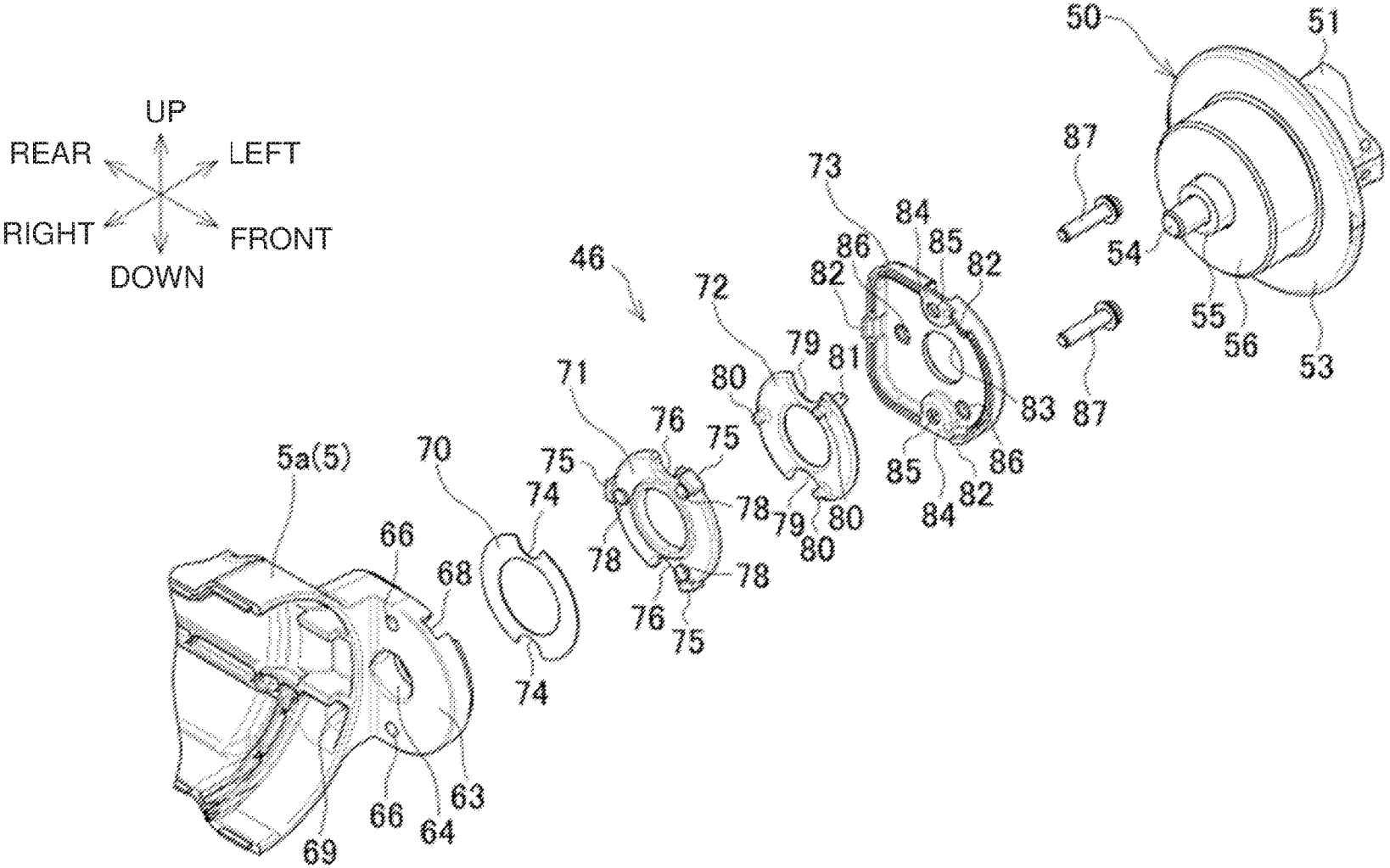
FIG. 9 is an exploded perspective view of the handle detector as viewed from the right.

FIG. 8 is an exploded perspective view of the handle mount 45 and the detector 46 as viewed from the left. FIG. 9 is an exploded perspective view of the detector 46 as viewed from the right.

Figure 5:
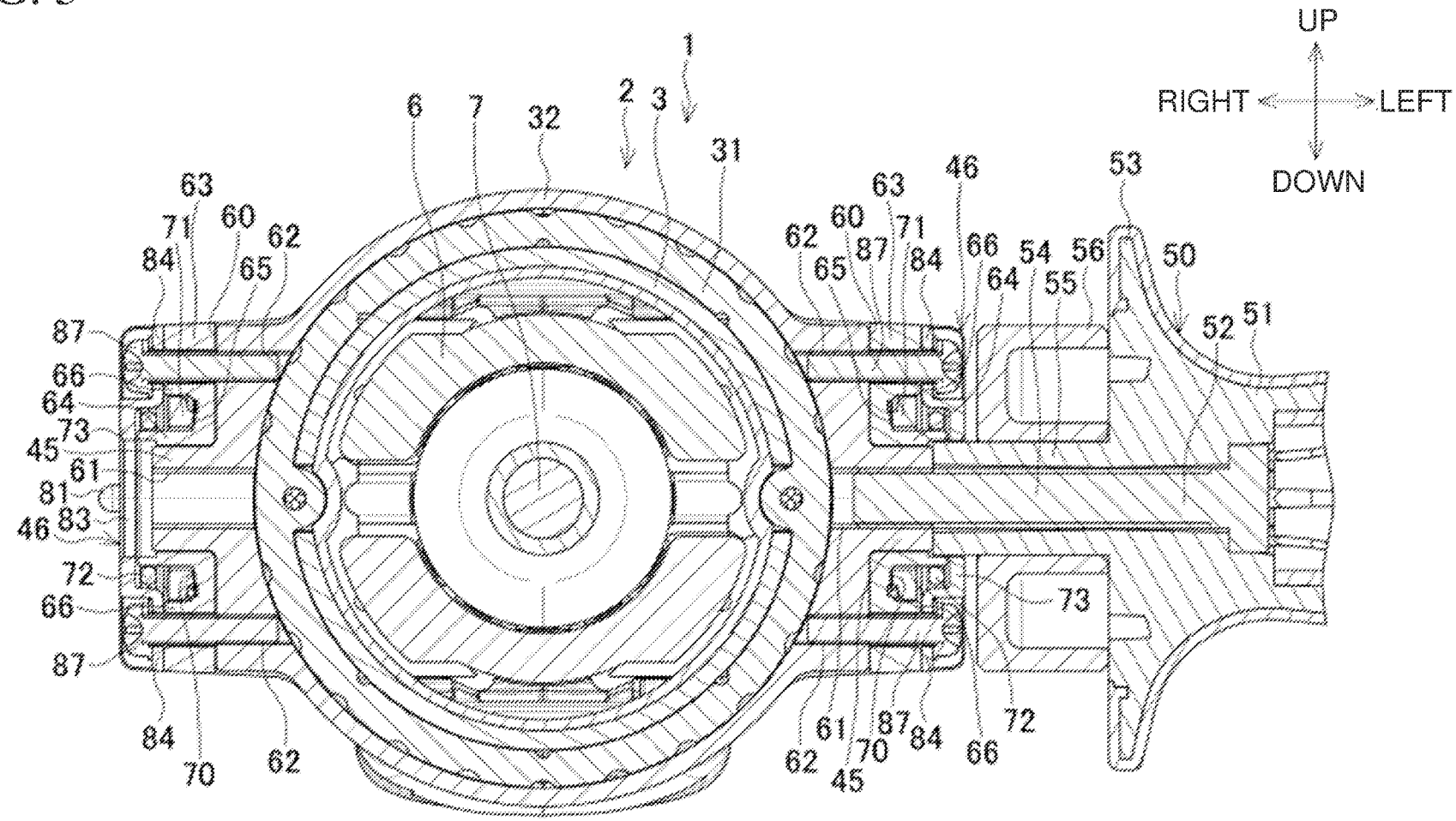
FIG. 5 is an enlarged sectional view taken along line B-B in FIG. 2.

The side handle 50 includes a grip 51 and a bolt 52, as also shown in FIG. 5. The grip 51 extends linearly and includes a flange 53 at its end. The bolt 52 is held at the center of the grip 51. A threaded portion 54 protrudes from the center of the flange 53. The flange 53 includes a boss 55 at its center. The boss 55 covers the circumference of the threaded portion 54 excluding the distal end. A contact plate 56 is fixed around the boss 55. The contact plate 56 is disk-shaped and coaxially surrounds the boss 55. The end face of the contact plate 56 is closer to the flange 53 than the end face of the boss 55 is. The boss 55 thus has an exposed distal end.

The fixing ring 32 has receiving surfaces 60 on its left and right side surfaces. Each receiving surface 60 is a flat surface defined in the front-rear direction and in the vertical direction. The receiving surface 60 extends in the vertical direction. The handle mount 45 protrudes from the center of each receiving surface 60 in the vertical direction. The handle mount 45 is cylindrical and protrudes leftward. The handle mount 45 has a first threaded hole 61 at its center. The first threaded hole 61 extends in the lateral direction and extends through the fixing ring 32 in the radial direction of the fixing ring 32. The side handle 50 is coaxially attached to the handle mount 45 with the threaded portion 54 screwed into the first threaded hole 61. The threaded portion 54 is screwable into until the end face of the boss 55 comes in contact with the end face of the handle mount 45, as shown in FIG. 5.

Each receiving surface 60 has second threaded holes 62 above and below the first threaded hole 61. The second threaded holes 62 have a smaller diameter than the first threaded hole 61 and extend parallel to the first threaded hole 61.

The rubber sleeve 31 is located inside the metal fixing ring 32. This structure insulates between the side handle 50 attached to the handle mount 45 and the internal components such as the motor 6.

The outer housing 5 includes the pair of left and right extensions 63 at its front end. The extensions 63 are plates extending laterally outward from the front end of the outer housing 5, and then protruding frontward on the right and left of the receiving surfaces 60 of the fixing ring 32. A front portion of each extension 63 is semicircular shape in a side view. The extension 63 includes a cylindrical portion 64. The cylindrical portion 64 extends through the extension 63 in the lateral direction. The cylindrical portion 64 is located at the center of the semicircular. The left end of the cylindrical portion 64 is fittable with the boss 55 of the side handle 50.

The extension 63 has, on the left, a receiving recess 65 that is concentric with the cylindrical portion 64. The receiving recess 65 is circular in a side view. The receiving recess 65 includes small cylindrical portions 66 above and below the cylindrical portion 64. The small cylindrical portions 66 extend through the extension 63 in the lateral direction. Each small cylindrical portion 66 is coaxially located leftward and outward from the corresponding second threaded hole 62 in the receiving surface 60 of the fixing ring 32. The receiving recess 65 includes three ribs 67 on the circumference behind the cylindrical portion 64. The ribs 67 are arc-shaped and are located circumferentially at intervals along the same circle centered at the cylindrical portion 64. The extension 63 has cutouts 68 at two positions in the vertical direction of the front portion and at the center in the vertical direction of its rear portion. A wiring hole 69 is located outside the ribs 67 and at the lower rear of the extension 63. The wiring hole 69 extends in the lateral direction.

The detector 46 is located on the extension 63. The detector 46 includes a pressure sensor 70, a pressure rubber 71, a movable plate 72, and an outer cover 73.

The pressure sensor 70 is a sheet with the resistance value changing with a load applied in the thickness direction. The pressure sensor 70 is annular in a side view. The pressure sensor 70 is located at the bottom of the receiving recess 65 with the cylindrical portion 64 extending through the center. The pressure sensor 70 includes cutouts 74 on the upper and lower circumferences. The cutouts 74 allow the pressure sensor 70 and the small cylindrical portions 66 to avoid interfering with each other. A first wire 90 is electrically connected to the pressure sensor 70. The first wire 90 extends from inside the outer housing 5 through the wiring hole 69 and outside the extension 63 to the left.

The pressure rubber 71 overlaps the pressure sensor 70 from the left inside the ribs 67. The pressure rubber 71 is a disk through which the cylindrical portion 64 extends. The pressure rubber 71 includes three tabs 75 on the circumference. Each tab 75 engages with the corresponding cutout 68 in the extension 63 from inside. The pressure rubber 71 includes semicircular inner cutout 76 on the upper and lower circumferences. The inner cutouts 76 avoid interference between the pressure rubber 71 and the small cylindrical portions 66. The pressure rubber 71 has recesses 77 on the left side radially inside the corresponding tabs 75. Multiple recesses 77 are located at equal intervals in the circumferential direction of the pressure rubber 71. Protrusions 78 are at the back of the corresponding recesses 77 on the right of the pressure rubber 71.

The movable plate 72 is located inside the ribs 67, and leftward and outward from the pressure rubber 71. The movable plate 72 is a disk through which the cylindrical portion 64 extends. The movable plate 72 includes semicircular outer cutouts 79 on the upper and lower circumferences. The outer cutouts 79 avoid interference between the movable plate 72 and the small cylindrical portions 66. The movable plate 72 includes, on both the left and right sides, inner pins 80 and outer pins 81 coaxial with each other. Multiple inner pins 80 and multiple outer pins 81 are located at equal intervals in the circumferential direction. Each inner pin 80 is located outside the corresponding recess 77 on the pressure rubber 71.

The outer cover 73 has the same shape as the extension 63 in a side view. The outer cover 73 includes multiple engaging projections 82 on the right side surface of its front portion and rear end. Each engaging projection 82 is aligned with the corresponding cutout 68 in the extension 63. The outer cover 73 has a round hole 83 in the front portion. The round hole 83 is coaxial with the left side of the cylindrical portion 64 of the extension 63. The round hole 83 receives the boss 55 on the side handle 50. A pair of receiving seats 84 are recessed above and below the round hole 83. Each receiving seat 84 has a through-hole 85. Each through-hole 85 is coaxial with the left side of the corresponding small cylindrical portion 66 of the left of the extension 63. The outer cover 73 has three small holes 86. Each small hole 86 receives the corresponding outer pin 81 on the movable plate 72.

The pressure sensor 70, the pressure rubber 71, and the movable plate 72 are installed in the receiving recess 65 in this order. The outer cover 73 then covers these components from the outermost position, and two screws 87 extend through the through-holes 85 and the small cylindrical portions 66 of the extension 63 from leftward and outward to be screwed into the second threaded holes 62 in the receiving surface 60. The handle mount 45 is thus integrally fixed to the extension 63 on the outer housing 5.

The pressure sensor 70 is then locked in a nonrotatable manner with the engagement of the small cylindrical portions 66 with the cutouts 74 at the bottom of the receiving recess 65. The pressure rubber 71 is locked in the receiving recess 65 in a nonrotatable manner with the engagement of the small cylindrical portions 66 with the inner cutouts 76 and the engagement of the tabs 75 with the cutouts 68 to place the protrusions 78 into contact with the pressure sensor 70. The movable plate 72 is accommodated between the pressure rubber 71 and the outer cover 73 in a movable manner in the lateral direction. With each inner pin 80 in contact with the corresponding recess 77 on the pressure rubber 71, the movable plate 72 is urged to the outermost position in which each outer pin 81 protrudes outward from the corresponding small hole 86 in the outer cover 73 with the elasticity of the pressure rubber 71, as in the right detector 46 in FIG. 7.

Figure 11:
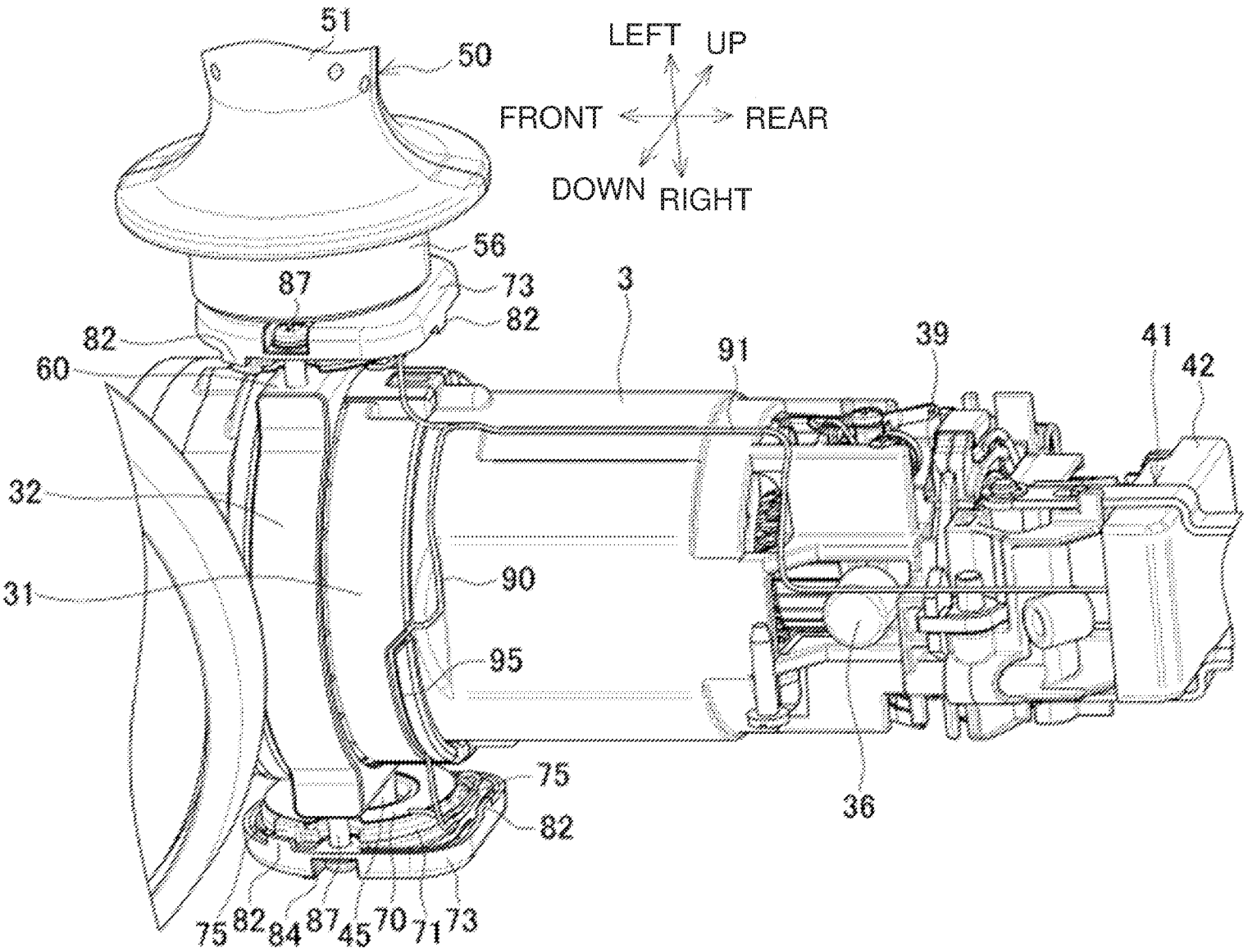
FIG. 11 is a perspective view of the grinder without showing an outer housing as viewed from below.
Figure 12:
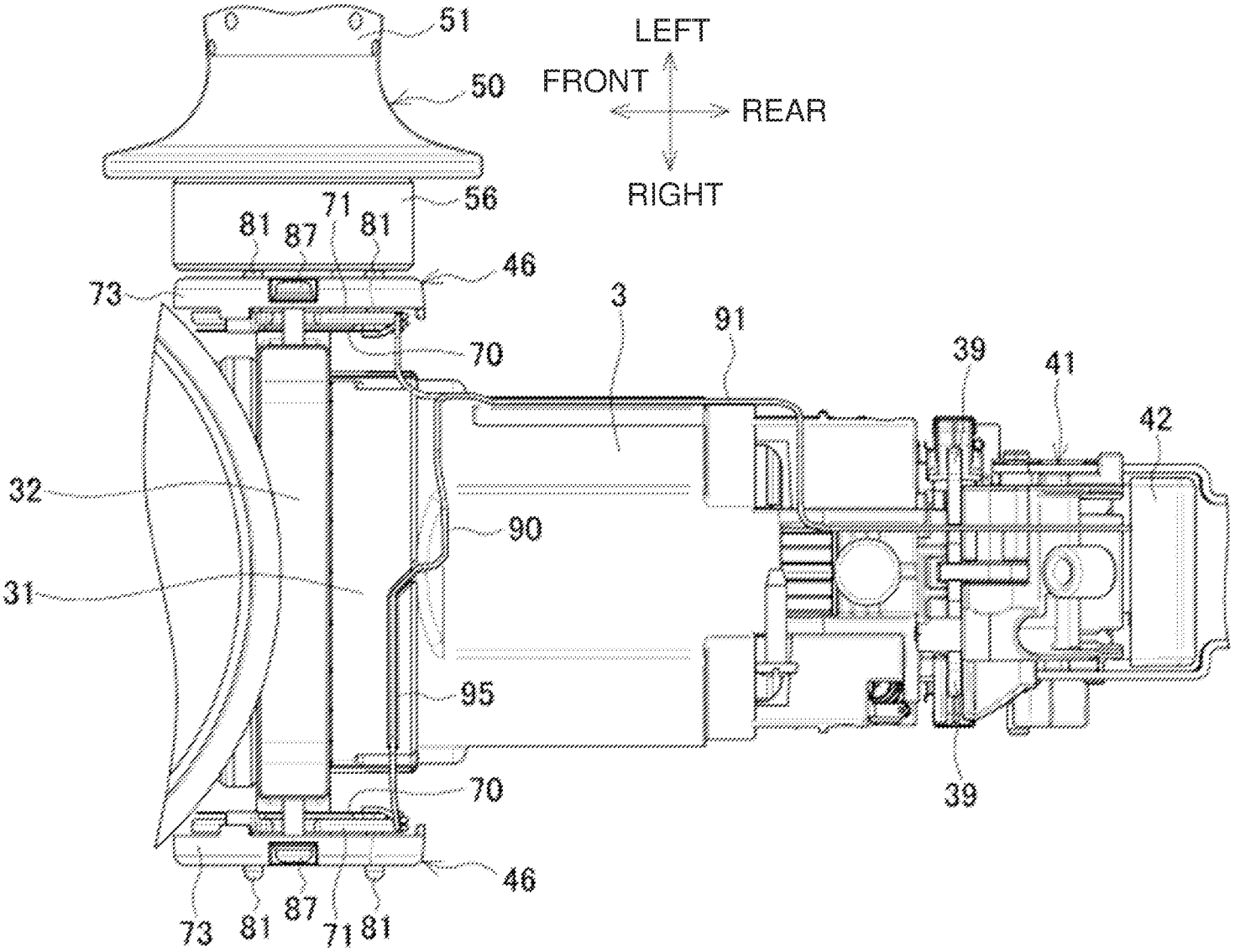
FIG. 12 is a bottom view of the grinder without showing the outer housing.

The pressure sensors 70 are electrically connected to the control circuit board 43 in the controller 42. As shown in FIGS. 11 and 12, the left and right pressure sensors 70 are electrically connected to each other with the first wire 90 including multiple signal lines. A second wire 91 including multiple signal lines is electrically connected to the first wire 90. The second wire 91 is connected to the control circuit board 43.

The first wire 90 and the second wire 91 are routed in the cylindrical space S between the inner housing 3 and the outer housing 5.

In the cylindrical space S, a pair of parallel first ridges 92 protrude on the front inner surface of the left housing half 5*a*, as shown in FIGS. 6 and 10. The first ridges 92 each have the upper end behind the wiring hole 69 in the left extension 63 and extend in the circumferential direction of the housing half 5*a* to the lower end of the housing half 5*a*.

A pair of parallel second ridges 93 protrude on the inner surface of the housing half 5*a*. The second ridges 93 each rise in the circumferential direction from near the lower inner surface of the housing half 5*a* in front of the holder 37 holding the rubber cap 36 and then extend frontward in the axial direction to connect with the upper end of the first ridges 92 behind the wiring hole 69 in the left extension 63. Multiple projections 94 are located in the ridges 92 and 93 to face each other. The multiple projections 94 protrude toward the inside of the ridges 92 and 93 at predetermined intervals in the direction in which the ridges 92 and 93 extend.

The rubber sleeve 31 has a guide groove 95 on the right lower surface of its right portion. The guide groove 95 slopes from the rear end at the middle in the lateral direction to the front right and then extends to the right in the circumferential direction.

The two ends of the first wire 90 are drawn through the wiring holes 69 in the left and right extensions 63 to the left and right of the extensions 63 and are electrically connected to the pressure sensors 70 in the receiving recesses 65. A middle portion of the first wire 90 is held in the cylindrical space S with its right portion fitted in the guide groove 95 on the rubber sleeve 31 and its left portion held between the first ridges 92 on the housing half 5*a*.

The second wire 91 drawn from the control circuit board 43 is routed frontward along the second ridges 93 while being held between the second ridges 93 in the cylindrical space S. The second wire 91 is then connected to the first wire 90 behind the left wiring hole 69.

When power is supplied from the power cable 30 in the grinder 1 according to the present embodiment, the microcomputer in the control circuit board 43 constantly monitors resistance values (load detection signals) of the pressure sensors 70 in the left and right detectors 46 through the first wire 90 and the second wire 91 and compares the values with a predetermined threshold.

Without the side handle 50 attached to the left or right handle mount 45, the resistance values of the pressure sensors 70 do not exceed the threshold. Thus, when the switch lever 29 is pushed in and the switch 28 is turned on in this state, the microcomputer does not drive the motor 6.

When the threaded portion 54 of the side handle 50 is screwed into either the left or right handle mount 45, the boss 55 comes in contact with the handle mount 45. In this state, a clearance smaller than the protruding amount of each outer pin 81 from the outer cover 73 is left between the left or right side surface of the outer cover 73 and the end face of the contact plate 56 in the side handle 50. Thus, each outer pin 81 in contact with the end face of the contact plate 56 is pressed. The movable plate 72 then moves laterally inward.

Each inner pin 80 on the movable plate 72 presses the corresponding recess 77 on the pressure rubber 71. Thus, each protrusion 78 on the back of the corresponding recess 77 presses the pressure sensor 70. This changes the resistance value. The resulting value is then input into the control circuit board 43 as a load detection signal. The microcomputer determines that the side handle 50 has been attached in response to the input resistance value exceeding the threshold value.

In this state, the switch lever 29 is pushed in to turn on the switch 28, causing the microcomputer to supply driving power to the motor 6. With the switch lever 29 being pushed in to release braking on the brake drum 38, the output shaft 7 rotates integrally with the brake drum 38. The rotation of the output shaft 7 is transmitted to the spindle 14 through the bevel gears 12 and 15. This causes the tip tool 19 to rotate. The operator holds the main grip 26 with one hand and the grip 51 in the side handle 50 with the other hand to, for example, grind the workpiece with the tip tool 19.

The grinder 1 according to the present embodiment includes the housing 2 extending in the front-rear direction to accommodate the motor 6, the spindle 14 protruding from the front of the housing 2 to receive a tip tool on the protruding end and rotatable when driven by the motor 6, the controller 42 that controls driving of the motor 6, the handle mounts 45 located at the front of the housing 2 to receive the side handle 50 (auxiliary handle) in a detachable manner, and the detectors 46 that electrically detects attachment of the side handle 50 to the handle mount 45.

The housing 2 includes the cylindrical inner housing 3 accommodating the motor 6 and the cylindrical outer housing 5 covering the exterior of the inner housing 3 and extending rearward from the inner housing 3. The first wire 90 and the second wire 91 electrically connecting the controller 42 and the detector 46 extend between the inner housing 3 and the outer housing 5. This structure facilitates wiring of the detector 46 and the controller 42 while avoiding the motor 6 and the fan 11.

The outer housing 5 is formed from a resin. The handle mount 45 is integral with the outer housing 5.

Thus, vibration of the motor 6 and other components is less likely to be transmitted to the side handle 50.

The grinder 1 includes the two handle mounts 45. The detectors 46 for the handle mounts 45 are connected to each other with the first wire 90. The single wire included in the second wire 91 connected to the first wire 90 is connected to the controller 42.

This simplifies the wiring between the controller 42 and the detector 46.

The inner housing 3 is held in the outer housing 5 with the rubber sleeve 31 (elastic member) in between.

This structure reduces vibration transmitted from the inner housing 3 to the outer housing 5 and avoids lowering operability of the operator holding the main grip 26.

The first and second ridges 92 and 93 (guides) are located on the inner surface of the outer housing 5 to guide the first wire 90 and the second wire 91.

Thus, the first wire 90 and the second wire 91 between the inner housing 3 and the outer housing 5 are easily routed.

Modifications of the present disclosure will now be described.

Figure 13:
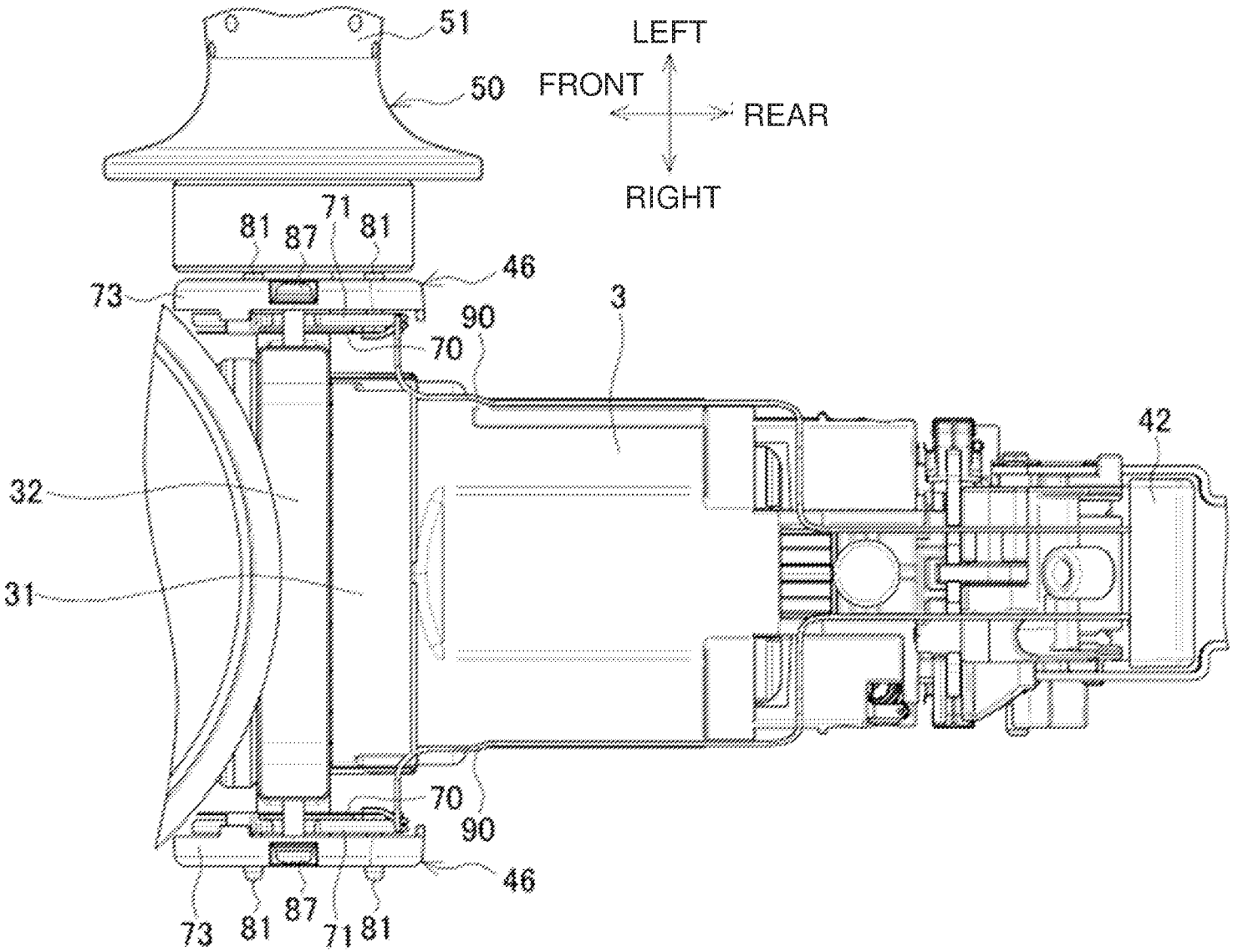
FIG. 13 is a bottom view of a grinder with wiring in a modification, without showing an outer housing.

In the present embodiment, the left and right pressure sensors are connected with the first wire 90, and the first wire 90 is connected to the controller with the single wire in the second wire 91. The wiring structure is not limited to this. For example, as shown in FIG. 13, the first wire 90 connected to each of the pressure sensors 70 in the left and right detectors 46 may be routed rearward to be connected directly to the controller 42.

Thus, the detectors 46 are connected to the controller 42 with the separate first wires 90 each for one of the detectors 46. With this structure, when one of the wires 90 is, for example, disconnected, the controller 42 determines that the handle is attached to neither detectors 46 despite the other wire 90 remains connected.

In this case, the right housing half 5*b* may also include the second ridges 93 to guide the wires 90.

The guide for the wiring is not limited to the ridges in the embodiment. The forms and the positions of the ridges may be changed as appropriate. The ridges may have different heights or may be located intermittently. The shapes and the positions of the projections on the ridges may also be changed. The projections may be eliminated.

The guide for the wiring is not limited to the ridges. For example, the outer housing may have a guide groove on its inner surface.

The guide for the wiring may be located on the outer surface of the inner housing instead of the inner surface of the outer housing. The inner surface of the outer housing and the outer surface of the inner housing may each have a guide to guide the wiring.

The wiring may extend through an upper or side portion of the cylindrical space instead of a lower portion.

The space between the inner housing and the outer housing may not be cylindrical. The structure may partially have a space extending through it in the axial direction when the wiring can be routed between the detector and the controller.

In any of the embodiment and the modifications, an indicator may be located to indicate an abnormality in, for example, wiring disconnection.

The detector may include any pressure sensor other than the single sheet pressure sensor described in the present embodiment. The detector may include, for example, an independent pressure sensor for each inner pin on the movable plate. In this case, the attachment of the side handle may be determined when the resistance values of one or more (e.g., two), but not all, of the pressure sensors exceed the threshold. More or fewer inner pins and pressure sensors may be used as appropriate.

In the present embodiment, although the detector detects the attachment of the side handle, the detector may also detect the holding of the grip. In this case, multiple pressure sensors may be installed to determine the holding of the grip based on any change in the resistance values of at least one of the pressure sensors due to the tilt of the side handle.

However, the detector may not include the pressure sensor. For example, as described in Patent Literature 1, the detector may be, for example, a unit including a detection plate with the position changeable in response to the attachment of the side handle and a photo interrupter that detects the position of the detection plate. The detector may have another structure.

In the present embodiment, without the side handle being attached, the controller restricts the motor from being driven when the switch is turned on. The structure is not limited to this. For example, when the switch is turned on without the side handle being attached, the controller may supply less driving power than normal to drive the motor. Under a less reaction force received by the tip tool from the workpiece, kickback is less likely to occur. In this case, simply holding the main grip for work is permissible.

The handle mount is not limited to indirect attachment to the outer housing with the fixing ring as in the present embodiment. The handle mount may be directly attached to the outer housing or the gear housing. The auxiliary handle is also not limited to the side handle in the present embodiment. For example, the shape of the grip may be changed as appropriate. The auxiliary handle may be connected with a structure other than the screwing.

The structures of the inner and outer housings are also not limited to the structures in the present embodiment. For example, the outer housing may not be halved. The inner housing may be halved.

The elastic support of the inner housing with the outer housing is also not limited to the structure in the present embodiment. For example, the length of the rubber sleeve may be changed, or multiple short rubber rings may be located in the axial direction. The elastic support may be eliminated.

The grinder may be a direct current (DC) tool powered by a battery pack, rather than an alternating current (AC) tool powered by utility power. The motor may be a brushless motor.

The grinding tool according to the present disclosure is not limited to a grinder. For example, the present disclosure is applicable to other grinding and polishing tools such as polishers and sanders. Thus, the handle mounts are not limited to a pair of left and right handle mounts. The handle mount may be either the left or right handle mount, or three or more handle mounts may be used.

REFERENCE SIGNS LIST

1 grinder
2 housing
3 inner housing
4 gear housing
5 outer housing
6 motor
7 output shaft
14 spindle
19 tip tool
25 body
26 main grip
28 switch
29 switch lever
42 controller
43 control circuit board
45 handle mount
46 handle detector
50 side handle
51 grip
52 bolt
54 threaded portion
60 receiving surface
61 first threaded hole
63 extension
65 receiving recess
69 wiring hole
70 pressure sensor
71 pressure rubber
72 movable plate
73 outer cover
77 recess
78 protrusion
80 inner pin
81 outer pin
87 screw
90 first wire
91 second wire
92 first ridge
93 second ridge
95 guide groove
S cylindrical space

What is claimed is:

1. A grinding tool, comprising:

a motor;

a housing extending in a front-rear direction, the housing including an inner housing being cylindrical and accommodating the motor, and an outer housing being cylindrical and covering an exterior of the inner housing, the outer housing extending rearward from the inner housing;

a spindle protruding from a front of the housing and being rotatable when driven by the motor, the spindle including a protruding end to receive a tip tool;

a controller configured to control driving of the motor;

a plurality of handle mounts located at the front of the housing to receive an auxiliary handle in a detachable manner;

a plurality of handle detectors each configured to electrically detect an attachment of the auxiliary handle to a corresponding one of the plurality of handle mounts; and a first wire and a single second wire extending between the inner housing and the outer housing to electrically connect the controller and the plurality of handle detectors, wherein:

the first wire connects the plurality of handle detectors to one another, and the single second wire connects the first wire to the controller, and the first wire is routed along a circumferential direction of the inner housing, and the single second wire is routed along a longitudinal direction of the inner housing.

2. The grinding tool according to claim 1, wherein the outer housing comprises a resin, and the plurality of handle mounts are formed integral with the outer housing.

3. The grinding tool according to claim 2, further comprising:

an elastic member, wherein the inner housing is held in the outer housing with the elastic member in between.

4. The grinding tool according to claim 2, further comprising:

a guide formed on at least one of an outer surface of the inner housing or an inner surface of the outer housing to guide the first wire and the second wire.

5. The grinding tool according to claim 1, further comprising:

an elastic member, wherein the inner housing is held in the outer housing with the elastic member in between.

6. The grinding tool according to claim 5, further comprising:

a guide formed on at least one of an outer surface of the inner housing or an inner surface of the outer housing to guide the wiring.

7. The grinding tool according to claim 1, further comprising:

a switch to turn on the motor, the switch being located rearward from the controller, wherein the controller is located rearward from the motor and the plurality of handle detectors.

8. A grinding tool, comprising:

a motor;

a housing extending in a front-rear direction, the housing including an inner housing being cylindrical and accommodating the motor, and an outer housing being cylindrical and covering an exterior of the inner housing, the outer housing extending rearward from the inner housing;

a spindle protruding from a front of the housing and being rotatable when driven by the motor, the spindle including a protruding end to receive a tip tool;

a controller configured to control driving of the motor;

a plurality of handle mounts located at the front of the housing to receive an auxiliary handle in a detachable manner;

a plurality of handle detectors each configured to electrically detect an attachment of the auxiliary handle to a corresponding one of the plurality of handle mounts;

wiring extending between the inner housing and the outer housing to electrically connect the controller and the plurality of handle detectors; and a switch to turn on the motor, the switch being located rearward from the controller, wherein:

the plurality of the handle detectors for the plurality of handle mounts is are each connected to the controller with a separate wire of the wiring, and the separate wire is drawn from the corresponding handle detector in a width direction of the inner housing and is routed along a longitudinal direction of the inner housing to connect to the controller that is located rearward from the motor and the plurality of handle detectors.

9. The grinding tool according to claim 8, further comprising:

an elastic member, wherein the inner housing is held in the outer housing with the elastic member in between.

10. The grinding tool according to claim 8, further comprising:

a guide formed on at least one of an outer surface of the inner housing or an inner surface of the outer housing to guide the wiring.

11. A grinding tool, comprising:

a motor;

a housing extending in a front-rear direction, the housing including an inner housing being cylindrical and accommodating the motor, and an outer housing being cylindrical and covering an exterior of the inner housing, the outer housing extending rearward from the inner housing;

a spindle protruding from a front of the housing and being rotatable when driven by the motor, the spindle including a protruding end to receive a tip tool;

a controller configured to control driving of the motor;

at least one handle mount located at the front of the housing to receive an auxiliary handle in a detachable manner;

a handle detector configured to electrically detect an attachment of the auxiliary handle to the at least one handle mount;

wiring extending between the inner housing and the outer housing to electrically connect the controller and the handle detector;

a guide including a pair of ridges formed on at least one of an outer surface of the inner housing or an inner surface of the outer housing to guide the wiring between the pair of ridges; and a switch to turn on the motor, wherein the switch is located rearward from the controller, and the controller is located rearward from the motor and the handle detector.

* * * * *